United States Patent [19]

Gantt

[11] Patent Number: 4,612,907

[45] Date of Patent: Sep. 23, 1986

[54] ARCHERY RELEASE AID

[75] Inventor: John V. Gantt, Pickens, S.C.

[73] Assignee: Gatomba, Inc., Pickens, S.C.

[21] Appl. No.: 555,717

[22] Filed: Nov. 28, 1983

[51] Int. Cl.[4] ..... F41C 19/00

[52] U.S. Cl. ..... 124/35 A

[58] Field of Search ..... 124/35 A, 24 R, 23 R, 124/35 R, 37

[56] References Cited

U.S. PATENT DOCUMENTS

| | | | |
|---|---|---|---|
| 2,417,791 | 3/1947 | Tyszkiewicz | 124/35 A |
| 2,786,461 | 3/1957 | Pelsue, Jr. | 124/35 R |
| 2,819,707 | 1/1958 | Kayfes et al. | 124/35 A |
| 2,842,114 | 7/1958 | Duncan | 124/35 R |
| 2,982,279 | 5/1961 | Pursley | 124/35 A |
| 3,446,200 | 5/1969 | Gross | 124/35 A X |
| 3,757,763 | 9/1973 | Pinti et al. | 124/35 A |
| 3,845,752 | 11/1974 | Barner | 124/35 A |
| 3,898,974 | 8/1975 | Keck | 124/35 A |
| 3,929,120 | 12/1975 | Barner | 124/35 A |
| 3,937,206 | 2/1976 | Wilson | 124/35 A |
| 3,998,202 | 12/1976 | Boyko | 124/35 A |
| 4,004,564 | 1/1977 | Castonguay | 124/35 A |
| 4,009,703 | 3/1977 | Cunningham | 124/35 A |
| 4,134,369 | 1/1979 | Cook | 124/35 A |

FOREIGN PATENT DOCUMENTS

| | | | |
|---|---|---|---|
| 959363 | 12/1974 | United Kingdom | 124/35 A |

*Primary Examiner*—William H. Grieb

*Attorney, Agent, or Firm*—Bailey & Hardaway

[57] ABSTRACT

Disclosed is an archery release aid which has a housing defining finger holes and a trigger within the housing defining a finger hole for permitting normal finger contraction to release a locking means to unlock a pivoted string engaging member and thus permit release of a bowstring or a rope engaging a bowstring.

7 Claims, 6 Drawing Figures

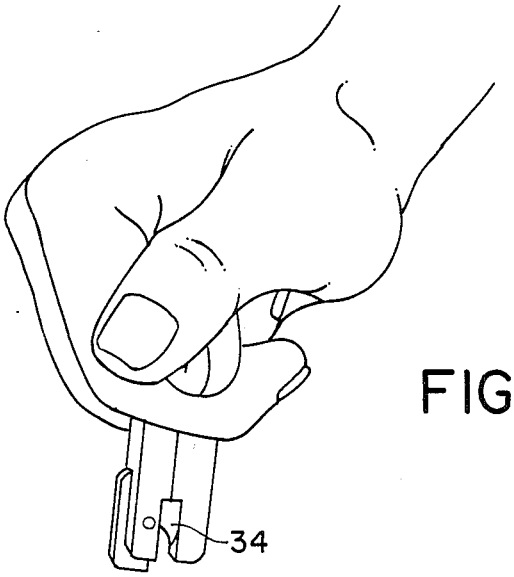
FIG. 2
FIG. 3
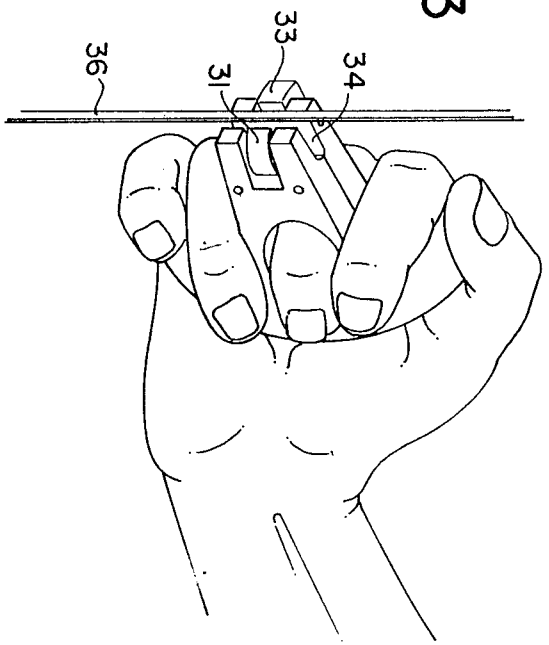

ARCHERY RELEASE AID

BACKGROUND OF THE INVENTION

This invention relates generally to the art of archery and more particularly to a release aid to assist manual manipulation and release of a bowstring.

Various release aids have existed in the prior art. An example is described in U.S. Pat. No. 3,998,202 wherein a release aid is described having a thumb actuated trigger to permit release of a bowstring.

U.S. Pat. No. 2,417,791 discloses a release which has a slot for receiving both the bowstring and an arrow tip. Various other release aids are described in the following U.S. Pat. Nos. 2,417,791; 2,786,461; 2,819,707; 2,982,279; 3,446,200; 3,898,974; 3,937,206; and 4,134,369.

While many prior art devices exist, there has been no single device which provides normal finger movement for trigger actuation and string release without influencing the normal movement of the string.

SUMMARY OF THE INVENTION

It is thus an object of this invention to provide a novel archery release aid.

It is a further object of this invention to provide an archery release aid which permits trigger actuation by normal finger contraction.

It is a further object of this invention to provide such a release aid which releases a tensioned bowstring without unduly influencing the path of movement of the arrow.

These as well as other objects are accomplished by an archery release and which has a housing defining finger holes and a trigger within the housing defining a finger hole for permitting normal finger contraction to release locking means to unlock a pivoted string engaging member and thus permit release of a bowstring or a rope engaging a bowstring.

BRIEF DESCRIPTION OF THE DRAWINGS

FIGS. 2 and 3 illustrate the operation of the release aid of FIG. 1.

DETAILED DESCRIPTION

In accordance with this invention it has been found that an archery release aid may be provided which permits normal finger contraction to release a bowstring through a pivotal string engaging member to permit string release without undue influence upon the normal path thereof and to thus permit an arrow to travel along its intended trajectory without undue influence from the release mechanism. Various other advantages and features of the release aid in accordance with this invention will become apparent from the following description given with reference to the various figures of drawing.

Figure 1:
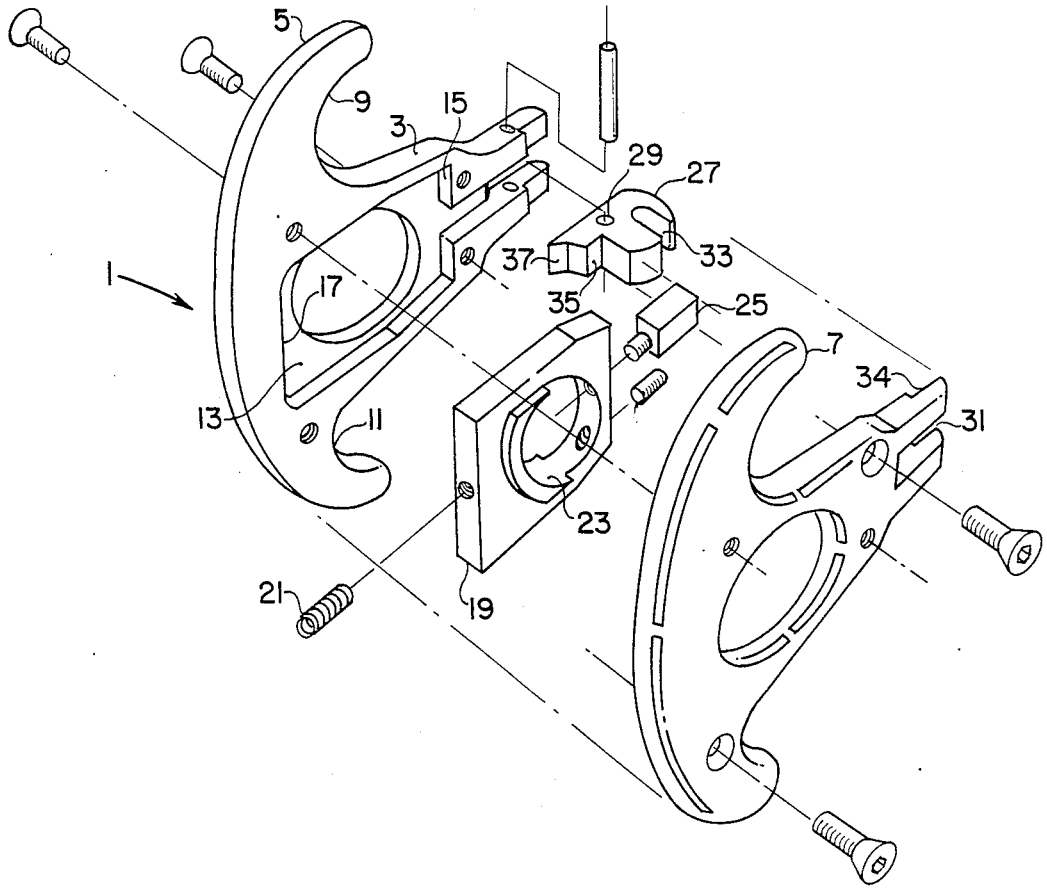
FIG. 1 is an assembly view in perspective of an archery release aid in accordance with this invention.

FIG. 1 of the drawing illustrates in perspective an assembly view of a release aid 1 in accordance with this invention while FIGS. 2 and 3 illustrate the use thereof. The release aid 1 of FIG. 1 comprises a housing 3 defined by sections 5 and 7. The housing defines finger holes 9 and 11 for the second and fourth fingers respectively.

The housing 3 defines within the interior thereof a trigger cavity 13 having a distal end 15 and a proximal end 17. Trigger 19 is moveable within trigger cavity 13 and is biased toward distal end 15 by biasing means 21.

Trigger 19 defines a finger hole 23 for receipt of the middle finger to permit actuation of the trigger toward the proximal end 17 of cavity 13 against the biasing of biasing means 21.

Trigger 19 communicates with locking means 25 for engagement with a pivoted string engaging member 27 which pivots about point 29 within slot 31 defined by housing 3. The pivoting string engaging member defines a string groove 33 which in cooperation with slot 31 defines a closed string path when member 27 is in a first position across slot 31 for retention of a bowstring therein. Housing 3 defines a string receiving slot 34, which cooperates with groove 33 for receipt of a string 36, FIG. 3, therein.

It can be seen that locking means 25 engages a mating surface 35 on string engaging member 27 to prevent rotation thereof when so engaged.

It is seen that by actuation of trigger 19 toward proximal end 17 that the locking member 25 disengages from the mating surfaces 35 of the string engaging member 27 to permit the string engaging member to rotate to a second position and thus provide an open path for a bowstring through slot 31 and string receiving slot 34, transverse thereto.

Member 27 has a second surface 37 which is engagable by locking means 25 when member 27 is in the second or open position. Member 27 is designed and balanced such that the member 27 will rotate to the second position due to the action of gravity when the entire release aid is horizontally located with the member 27 toward the ground and the trigger is in the release position at the proximal end of a cavity 13. This is illustrated in FIG. 2 of the drawings.

The device in accordance with this invention is thus easily loaded from such a position by merely moving a bowstring into string receiving slot 34 which thus moves into groove 33 and with a small amount of tension rotates member 27 into the first position where it is thus locked by locking means 25. The bowstring will remain locked in the closed string path defined by the slot 31, string receiving slot 34 and groove 33 until trigger 19 is actuated by contraction of the middle finger.

The release aid as above described possesses many advantages not heretofore possessed by the prior art. The overall shape of the housing 3 defines two fingergrips which together with finger hole 23 provide a normal hand configuration to permit tensioning of a bowstring in the normal manner and which permits actuation of a trigger by a mere continuation of the finger contraction process already begun during the string tensioning maneuver. This natural movement advantage is coupled with the pivotal release mechanism which imparts minimal deflection upon the intended string paths so as to provide for an arrow trajectory consistent with the aim prior to release.

Figure 4:
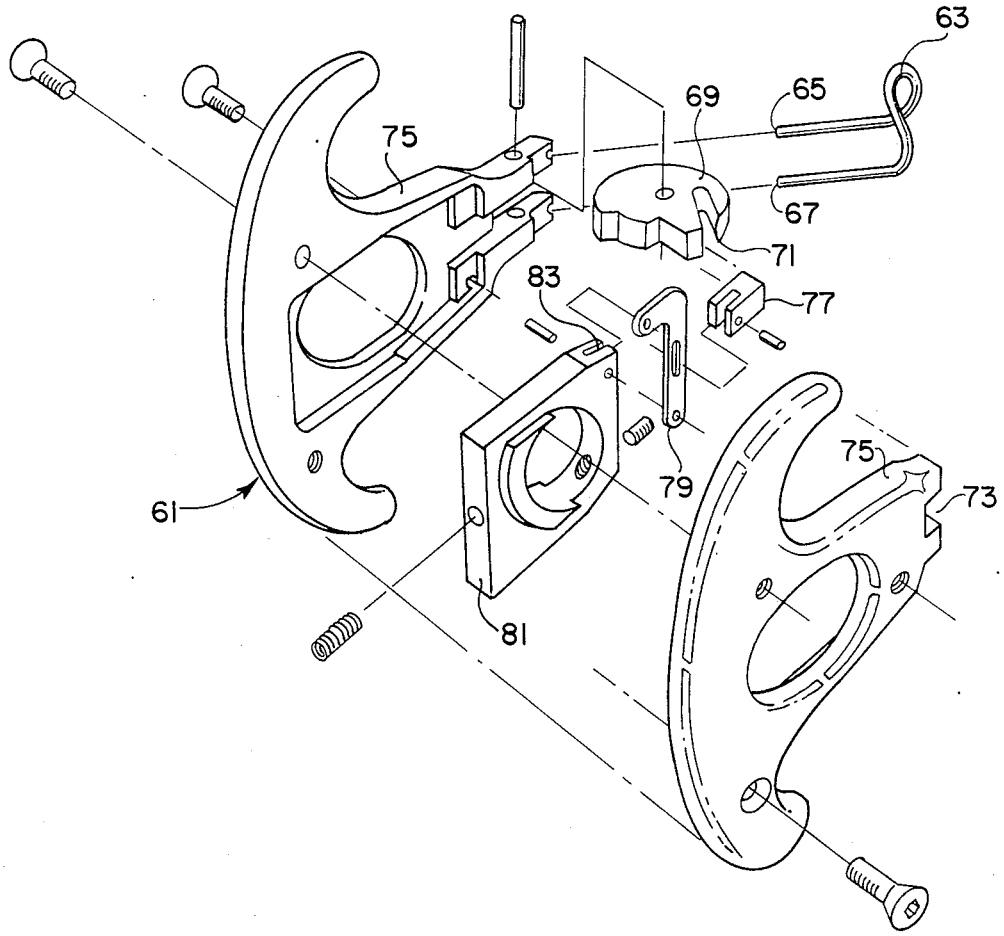
FIG. 4 of the drawings illustrates in perspective an assembly view of release aid in accordance with this invention utilizing a rope release.
Figure 5:
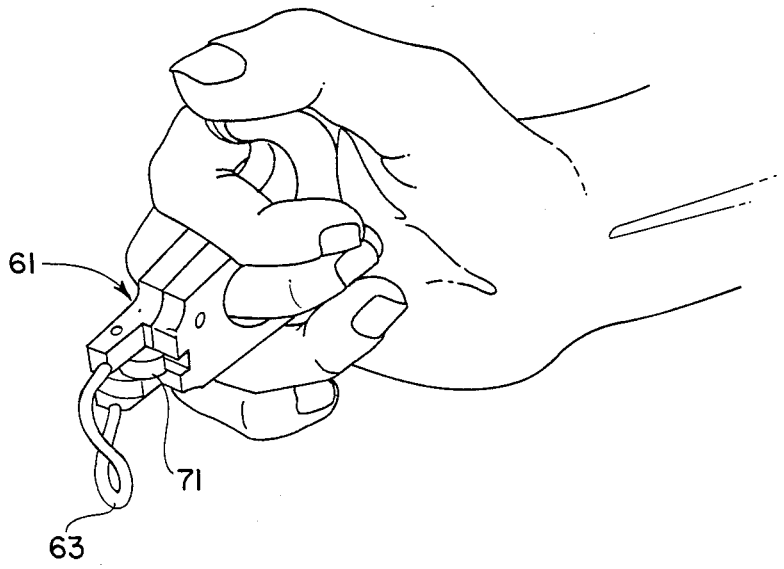
FIGS. 5 and 6 illustrate the operation of FIG. 4 release aid.
Figure 6:
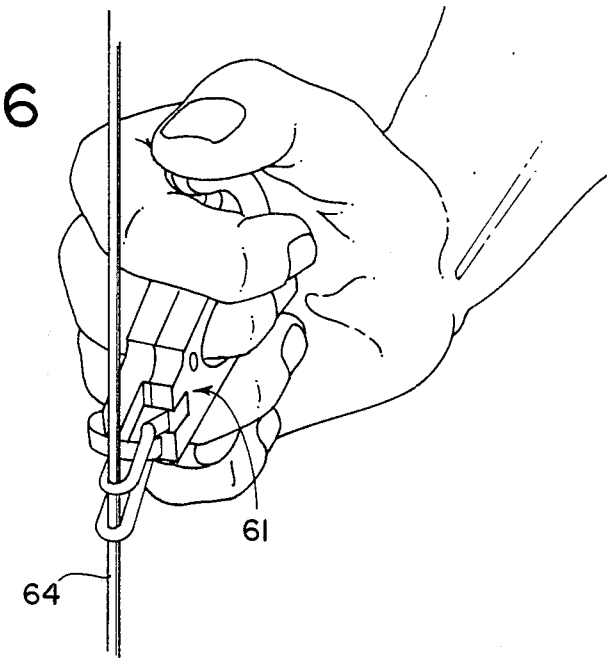

FIG. 4 of the drawing provides a modification of the device in accordance with FIG. 1 which provides for a rope release to engage a bowstring. This type of release is preferred by many archers and in accordance with FIG. 4 embodiment is coupled with the advantageous finger orientation and trigger release. The use of the FIG. 4 embodiment is illustrated in FIGS. 5 and 6.

It is seen in FIG. 4 that the release aid 61 comprises a generally U-shaped rope 63 which is attached to the housing 75 at open ends 65 and 67 and with its closed end 63 is engagable with pivotal string engaging member 69 at groove 71. String engaging member 69 is rotatable through slot 73 defined by the housing 75.

It can be seen that the locking means is of somewhat different configuration in the FIG. 4 embodiment in that the locking means comprises a pin 77 which operates through a lever linkage 79 to communicate with trigger 81 at 83. Lever linkage 79 is utilized in the rope release aid 61 in order to reduce the force required to about one-half of that required for release in the FIG. 1 embodiment. This mechanical advantage of course increases the distance of trigger pull.

The release aid 61 in the FIG. 4 embodiment operates similar to the release aid of FIG. 1 with the exception that the rope 63 communicates with the bowstring 64 and releases the bowstring when the rope 63 is itself released from the path defined by groove 71.

The rope model 61 of FIGS. 4 through 6 operates differently for loading than the FIG. 1 embodiments in that the string engaging member 69 rotates to the cocked position by action of gravity as illustrated in FIG. 5 for string engagement as illustrated in FIG. 6. For this purpose string engaging member 69 is shaped and balanced differently from string engaging member 27 of FIG. 1.

It is thus seen that the release aid in accordance with this invention provides a novel release aid which permits trigger actuation by normal finger contraction and which releases a tensioned bowstring without unduly influencing the path of movement of the arrow. As many variations will be apparent from a reading of the above specification, such variations are within the spirit and scope of the invention as defined by the following appended claims.

That which is claimed is:

1. An archery release aid comprising:

a housing having a distal end and a proximal end defining finger grips and a trigger cavity;

a trigger in said trigger cavity;

biasing means biasing said trigger toward said distal end;

a pivoted string engaging member pivotally mounted on said housing at said distal end pivoting from a first position defining with said housing a closed string path whereby a bow string is retained within said release aid and a second position to define an open string path to release said bow string;

locking means extending from said trigger to said string engaging member to lock said string engaging member in said first position, said biasing means normally biasing said trigger and said locking means toward said string engaging member to lock said member in said first position;

said trigger defining a finger hole to permit finger movement of said trigger toward a proximal end of said trigger cavity and the proximal end of said housing against the biasing thereof to disengage said locking means and permit said pivoted string engaging member to pivot to said second position for release of a bow string.

2. The archery release aid of claim 1 wherein said pivoted string engaging member is rotatable about a pivot point to permit gravitational forces to pivot said pivoted string engaging member to said second position when said locking member is disengaged and when said release aid is horizontally oriented toward the ground.

3. The archery release aid according to claim 1 wherein said release aid further comprises a U-shape rope section attached to said housing with the closed end thereof engagable with said string engaging member to permit use of said rope to engage a bow string.

4. The archery release aid according to claim 1 therein said housing defines a string slot and said pivoted string engaging member rotates through said slot to said first position and out of said slot to said second position.

5. The archery release aid according to claim 3 wherein said pivoted string engaging member defines a string groove which in cooperation with said string receiving slot defines a closed path for a string until release of said locking means to open said path.

6. The archery release aid according to claim 2 wherein locking means comprises a locking pin for contacting said pivoted string engaging member, and levered linkage communicating between said locking pin and said trigger.

7. The archery release aid according to claim 1 wherein said housing defines finger grips for the second and fourth fingers and said fingerhole is adapted for a middle finger whereby contraction of the middle finger within the fingerhole of said trigger moves said trigger toward said proximal end to release said lock means.

* * * * *